US008381960B2

(12) United States Patent
Bruggmueller et al.

(10) Patent No.: US 8,381,960 B2
(45) Date of Patent: Feb. 26, 2013

(54) HAND-HELD DRIVE-IN TOOL

(75) Inventors: Peter Bruggmueller, Feldkirch (AT); Robert Spasov, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 1342 days.

(21) Appl. No.: 11/796,041

(22) Filed: Apr. 25, 2007

(65) Prior Publication Data

US 2007/0251973 A1 Nov. 1, 2007

(30) Foreign Application Priority Data

Apr. 27, 2006 (DE) ..... 10 2006 000 202

(51) Int. Cl.
*B25C 1/06* (2006.01)

(52) U.S. Cl. ..... 227/131; 227/120; 124/17

(58) Field of Classification Search ..... 227/131; 124/17, 20.1, 20.2, 20.3, 21, 22, 23.1, 24.1, 124/25

See application file for complete search history.

(56) References Cited

U.S. PATENT DOCUMENTS 1,484,930 A * 2/1924 Bunten ..... 124/21
1,568,999 A * 1/1926 Bunten ..... 124/21
2,372,906 A * 4/1945 Menzies ..... 83/239
2,575,455 A * 11/1951 Lang ..... 227/138
2,638,885 A * 5/1953 Keadle ..... 124/20.1
4,323,127 A 4/1982 Cunningham
4,544,090 A 10/1985 Warman et al.
4,807,585 A * 2/1989 Gegere ..... 124/21
5,118,023 A 6/1992 Fushiya et al.
5,220,906 A * 6/1993 Choma ..... 124/25
5,261,384 A * 11/1993 Hu ..... 124/66
5,320,270 A * 6/1994 Crutcher ..... 227/131
5,575,482 A * 11/1996 Butler, Jr. ..... 124/17
5,595,165 A * 1/1997 Conte ..... 124/18
5,931,145 A * 8/1999 Oviedo-Reyes ..... 124/20.3
6,672,239 B1 * 1/2004 Gieseke ..... 114/316
6,708,585 B1 3/2004 Posenauer
6,799,566 B1 * 10/2004 Malucelli ..... 124/25
6,997,367 B2 * 2/2006 Hu ..... 227/132
7,201,303 B2 * 4/2007 Leimbach ..... 227/131
2007/0023472 A1 * 2/2007 Schiestl ..... 227/132

* cited by examiner

*Primary Examiner* — Lindsay Low

(74) *Attorney, Agent, or Firm* — Adelman, Frayne & Schwab

(57) ABSTRACT

A hand-held drive-in tool (10) for fastening elements (60) includes a driving unit (30) for a drive-in ram (13) which is displaceably mounted in a guide (12), and has at least one driving element for the drive-in ram (13) formed by an elastomeric band (31) and tensioned by a tensioning device (70).

6 Claims, 2 Drawing Sheets

HAND-HELD DRIVE-IN TOOL

BACKGROUND OF THE INVENTION

1. Field of the Invention

The present invention relates to a hand-held drive-in tool for driving fastening elements in a workpiece and including a drive-in ram, a guide in which the drive-in ram is displaceable, a driving unit for displacing the drive-in ram and having at least one driving element that displaces the drive-in ram, a device for tensioning the at least one driving element.

2. Description of the Prior Art

In the drive-in tools of the type described above, a mechanical driving spring, which can be tensioned by a tensioning mechanism, serves as a driving source for the drive-in ram. It is advantageous that the mechanical driving spring is inexpensive so that a drive-in tool of this kind can be produced economically. Further, mechanical springs have the advantage over gas springs that consists in that tensioning of the mechanical spring does not lead to increases in temperature as is the case in gas springs, and that a tensioned spring does not lose the stored energy for a long time, whereas in a gas spring, the energy is gradually lost because of leakage.

However, compared to gas springs, mechanical springs have the disadvantage that when tension is released quickly they lose a considerable portion of the energy stored in the spring because this energy must be expended for accelerating the spring own mass. Since the mass of a mechanical spring is much greater than that of a gas spring, this loss is much greater compared to gas springs. Since an impact process which occurs in the drive-in tools considered herein leads to a very quick release of tension in the spring, the phenomenon described above is very noticeable.

A drive-in tool of the type discussed above is disclosed in DE 40 13 022 A1. This drive-in tool has an impact mechanism which can be driven toward a tool muzzle by a spring for impacting a nail to drive the nail in. An adjusting device for returning the impact mechanism into its initial position has an electric motor and a speed reduction mechanism for the electric motor. A rotary movement of the electric motor is transmitted by the speed reduction mechanism and a toothed disk meshing with the latter, to a hammer body of the impact mechanism for transferring the impact mechanism against the force of the spring into the initial position in which the impact mechanism is ready for an impact process.

The known drive-in tool is disadvantageous in that the ram speed cannot exceed 15 to 20 m/s, which is not sufficient for applications requiring a setting energy higher than 10 to 20 J, e.g., for setting in steel or concrete. This is a result of the circumstance described above that the mechanical spring must expend a portion of the stored energy for accelerating the spring own mass so that this portion of energy cannot be used for accelerating the impact device. Attempting to increase the impact speed of the drive-in tool by providing a stronger spring of the same design only increases the spring own mass, which increases the energy lost in accelerating the spring own mass so that no increase in speed is achieved in the end result.

Therefore, it is the object of the present invention to develop a drive-in tool which avoids the disadvantages discussed above and which makes it possible to increase the drive-in speed while retaining a high drive-in energy by employing simple technical means.

SUMMARY OF THE INVENTION

This and other objects of the present invention, which will become apparent hereinafter, are achieved according to the invention by forming the at least one driving element of an elastomeric band. Further, a locking device is provided for the drive-in ram for fixing the drive-in ram in a tensioned position of the elastomeric band in a reversible manner.

Due to the extremely high extensibility of the at least one elastomeric band, this elastomeric band can store the same kinetic energy as a steel spring of comparable length, but has appreciably less weight. Due to the lower density of the elastomeric band and due to the longer acceleration path, higher setting speeds above 20 m/s can also be achieved. The driving element is tensioned by a tensioning device that is driven by an electric driving unit. The time required for tensioning the driving element is several tenths of a second when the tensioning device is so designed that it can be installed in a hand-held device of moderate weight and structural dimensions. The drive-in ram can be tensioned already before the trigger switch is actuated and held by the locking device (e.g., when the user presses the drive-in tool against a workpiece) so that the setting process can be initiated without delay after actuating the trigger switch. As a result, the user does not experience an annoying time delay between the actuation of the trigger switch and the actual drive-in process of the drive-in tool. Further, holding of the driving element in the locked position directly by means of the electric driving unit of the tensioning device, which could cause very high heating and extreme loading of the electric drive, can be avoided.

In an advantageous manner, two elastomeric band which are connected in parallel and which are preferably arranged symmetrically to one another and to the drive-in ram are provided, so that the acceleration forces of the elastomeric bands are added and can be introduced symmetrically into the drive-in ram.

Further, it is advantageous when the elastomeric band is arranged geometrically parallel to a movement axis of the drive-in ram so that energy losses can be minimized.

In a solution which can be implemented easily in technical respects, the locking device advantageously has a pawl for holding the drive-in ram in the tensioned position of the elastomeric band, which pawl can be moved into a releasing position of the drive-in ram by a trigger switch.

It is further advantageous that the drive-in ram is guided not only by a guide but additionally by other guide means which preferably extend parallel to the drive-in direction. This ensures that the drive-in ram properly strikes the fastening element. Since the elastomeric band, because of its flexibility, cannot guide the drive-in ram, it is advantageous to guide the drive-in ram at two locations along the drive-in path to ensure a defined drive-in motion in a straight line.

In a solution which can be implemented easily in technical respects, the guide means have a guide channel in the drive-in ram through which a guide rod is guided.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
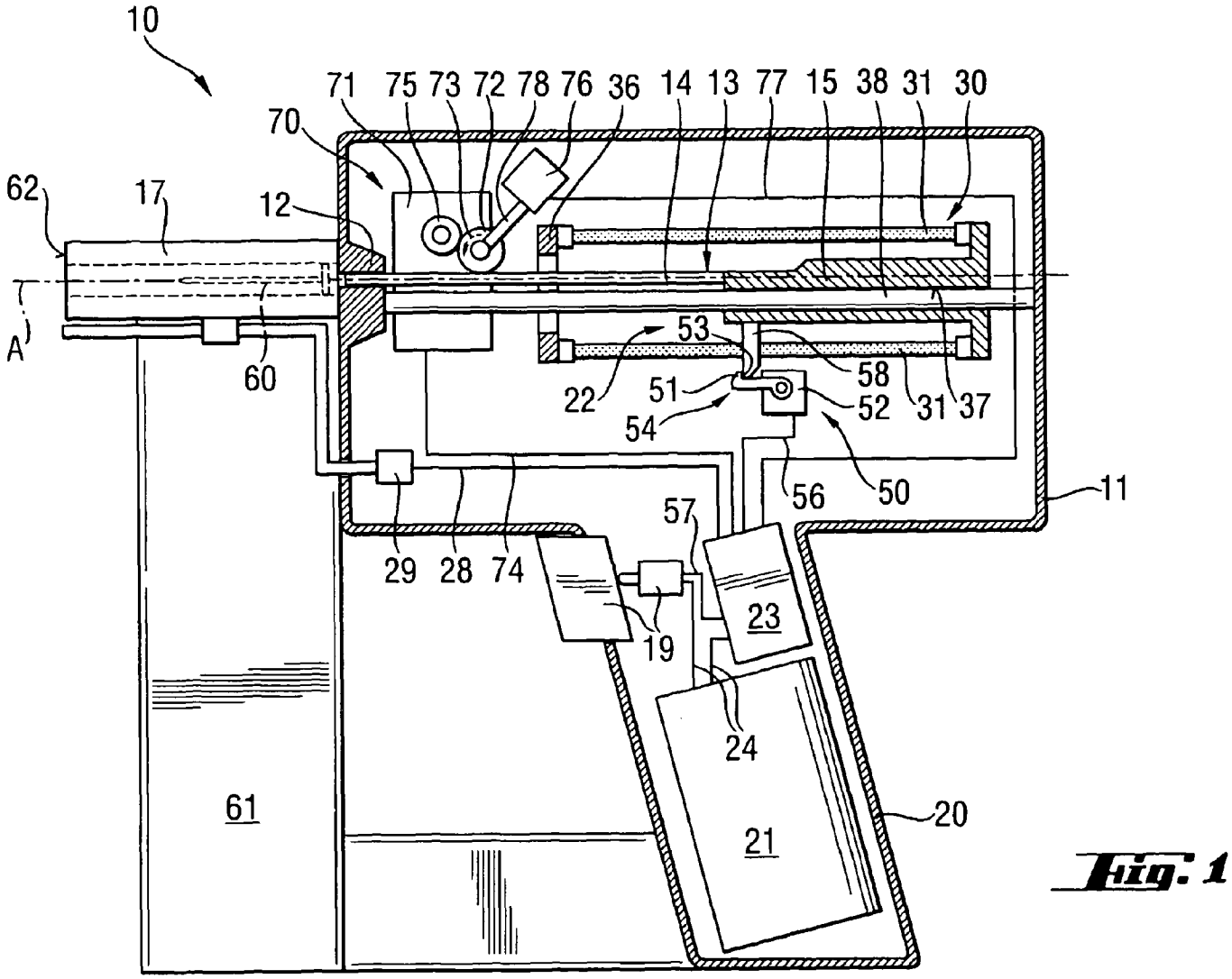
FIG. 1 shows a side longitudinal cross-sectional view of a drive-in tool according to the invention in its initial position.
Figure 2:
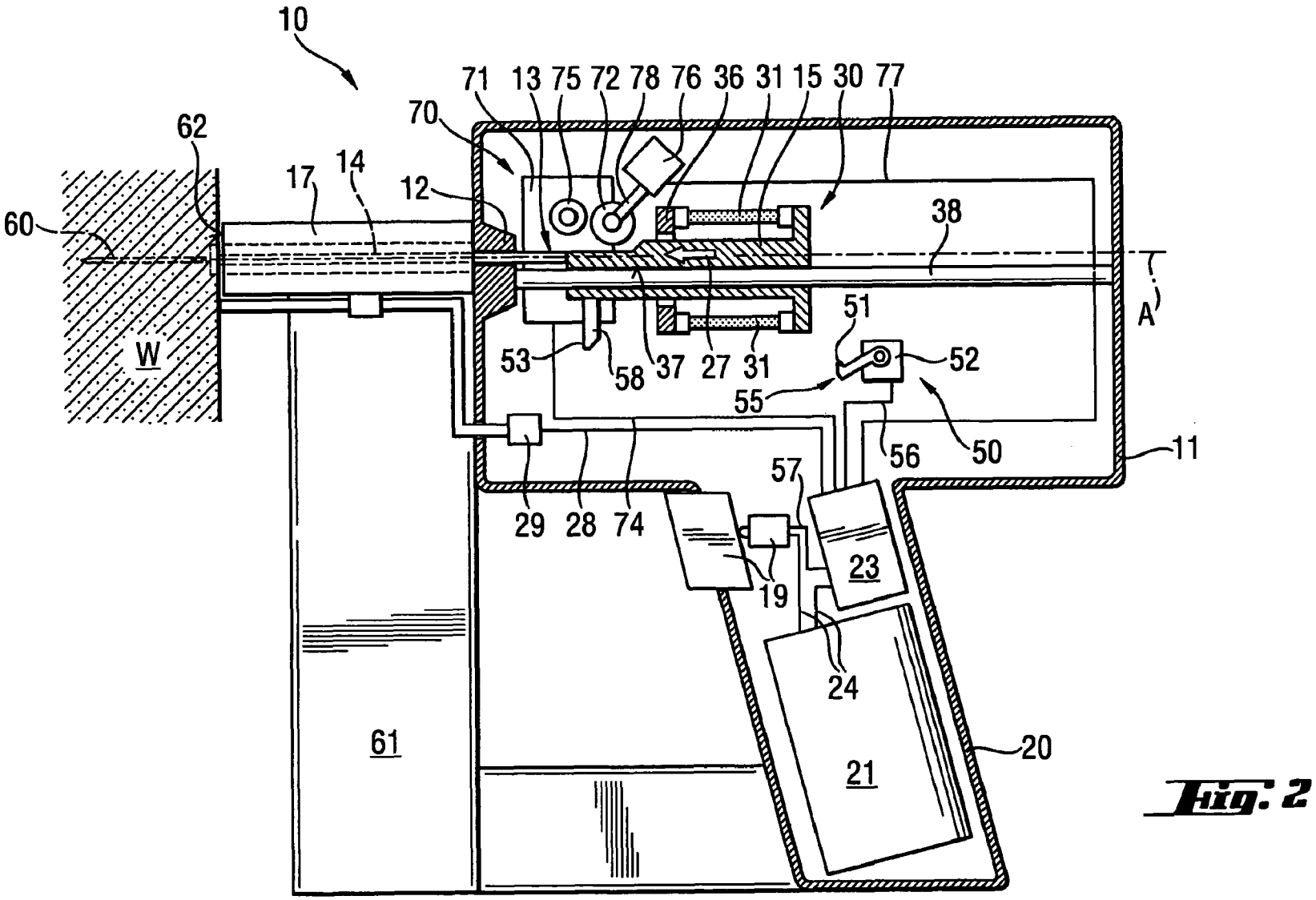
FIG. 2 shows a view similar to that of FIG. 1 in actuated position of the drive-in tool.

The drive-in tool 10 according to the present invention, which is shown in FIGS. 1 and 2, has a housing 11 and a driving unit, designated in its entirety by 30, for a drive-in ram 13. The driving unit 30 is arranged in the housing 11. The drive-in ram 13 has a drive-in portion 14 for driving a fastening element 60 and a head portion 15. The drive-in portion 14 is displaceable in a guide 12 while the head portion 15 has a guide channel 37 which provides for displacement of the head portion 15 on a guide rod 38.

A bolt guide 17 adjoins the end of the guide 12 in drive-in direction 27 (see FIG. 2) and extends coaxially with the guide 12. A fastening element magazine 61, in which fastening elements 60 are stored, is arranged so as to project laterally from the bolt guide 17.

The driving unit 30 has driving elements which are formed as elastomeric bands 31 and which are secured at one end to a support point 36, which is stationary with respect to the housing, and at the other end to the head portion 15 of the drive-in ram 13.

In the initial position 22 of the drive-in ram 13 shown in FIG. 1, the drive-in ram 13 is elastically biased by means of the elastomeric bands 31 and lies with the free end of its head portion 15 in a rear area of the housing 11 remote from the bolt guide 17.

In the initial position 22, the drive-in ram 13 is held by a locking device, designated in its entirety by 50 and having a pawl 51 that engages, in a locking position 54 (see FIG. 1), a locking surface 53 of a projection 58 of the drive-in ram 13 and holds the drive-in ram 13 against the force of the elastomeric bands 31. The pawl 51 is supported on an actuating motor 52 and can be moved by the latter into a releasing position 55 shown in FIG. 2, as will be described further below. The actuating motor 52 is connected to a control unit 23 by a first electric control conductor 56.

The drive-in tool 10 further has a handle 20 on which a trigger switch 19 is arranged for initiating a drive-in process with the drive-in tool 10. In the handle 20, there is further arranged a power supply, designated in its entirety by 21, which supplies electrical energy for the drive-in tool 10. In the present instance, the power supply 21 contains at least one storage battery. The power supply 21 is connected to both the control unit 23 and the trigger switch 19 by electric power conductors 24. The control unit 23 is also connected to the trigger switch 19 by a switch conductor 57.

Switching means 29 which are electrically connected to the control unit 23 by a switching means 28 are arranged at a tool muzzle 62 of the drive-in tool 10. The switching means 29 sends an electric signal to the control unit 23 as soon as the drive-in tool 10 is pressed against a workpiece W, as is shown in FIG. 2, and accordingly ensures that the drive-in tool 10 can only be actuated when it is pressed against the workpiece W in the proper manner.

Further, a tensioning device, designated in its entirety by 70, is arranged in the drive-in tool 10. This tensioning device 70 has an electric driving motor 71 by which a driving roller 72 can be driven. The electric driving motor 71 is electrically connected to the control unit 23 by a second control lead 74 and can be set in operation by means of this control unit 23 when, e.g., the drive-in ram 13 is located in its end position in the drive-in direction 27 or when the drive-in tool 10 is lifted off the workpiece W. The electric driving motor 71 has output means 75 such as a driven wheel which can be coupled with the driving roller 72. To this end, the driving roller 72 is rotatably mounted on a longitudinally adjustable adjusting arm 78 of adjusting means 76 formed as a solenoid. The adjusting means 76 is connected to the control unit 23 by an adjusting lead 77. During operation, the driving roller 72 rotates in the direction indicated by arrow 73 which is shown with dashed lines.

When the drive-in tool 10 is put into operation by means of a main switch, not shown, the control unit 23 first ensures that the drive-in ram 13 is in its initial position 22 shown in FIG. 1. If this is not the case, then the driving roller 72 is advanced by the adjusting means 76 toward output means 75, which have already been set in rotation by the electric driving motor 71, and engages the output means 75. Simultaneously, the driving roller 72 engages the drive-in ram 13 so that the latter is displaced farther away from the bolt guide 17 into the housing 11 in direction of its movement axis A by its head portion 15 by means of the driving roller 72 which rotates in the direction shown by the arrow 73. In this manner, the elastomeric bands 31 of the driving unit 30 are tensioned. If the drive-in ram 13 has reached its initial position 22, the pawl 51 of the locking device 50 drops into the locking surface 53 at the drive-in ram 13 and holds the latter in the initial position against the tensile force of the elastomeric bands 31. The electric driving motor 71 can then be switched off by the control unit 23, and the adjusting means 76 move the driving roller 72 again, so as to be controlled by the control unit 23, from its engaged position at the output means 75 and the drive-in ram 13 into its disengaged position (see FIG. 2).

When the drive-in tool 10 is pressed against a workpiece W as is shown in FIG. 2, the control unit 23 is first brought into its setting-ready position by the switching means 29. When the trigger switch 19 is actuated by a user, the control unit 23 displaces the locking device 50 into its release position 55, and the pawl 51 is lifted off the locking surface 53 at the drive-in ram 13 by the actuating motor 52. The pawl 51 can be spring-loaded in direction of the drive-in ram 13 for this purpose.

The drive-in ram 13 is then moved in the drive-in direction 27 by the elastomeric bands 31 of the driving unit 30, and a fastening element 60 is driven into the workpiece W.

To return the drive-in ram 13 and to tension the elastomeric bands 31, the tensioning device 70 is activated by the control unit 23 at the end of a drive-in process when the drive-in tool 10 is lifted off the workpiece W. The switching means 29 supply a signal to the control unit 23 for this purpose. The drive-in ram 13 is moved by means of the tensioning device 70 in the manner already described above against the elastomeric bands 31 of the driving unit 30 and the elastomeric bands 31 are tensioned once again until the pawl 51 can again drop into its locking position 54 at the locking surface 53 of the drive-in ram 13.

The occasional holding of the drive-in ram 13 by the locking device 70 ensures that the elastomeric bands 31, which may possibly start to oscillate during the tensioning process, can stop oscillating before a new setting process is begun.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements in a workpiece, comprising a drive-in ram (13); a guide (12) in which the drive-in ram (13) is displaceable; a driving unit (30) for displacing the drive-in ram (13) and having at least one elastomeric band (31) that displaces the drive-in ram (13); a device (70) having an electric driving motor (71) for tensioning the at least one elastomeric band (31); and a locking device (50) for releasably securing the drive-in ram (13) in a tensioned position of the at least one elastomeric band (13).

2. A drive-in tool according to claim 1, comprising at least two elastomeric bands (31) extending parallel to each other.

3. A drive-in tool according to claim 1, wherein the at least one elastomeric band (31) is arranged parallel to a movement axis (A) of the drive-in ram (13).

4. A drive-in tool according to claim 1, wherein the locking device (50) has a pawl (51) for holding the drive-in ram (13) in the tensioned position of the elastomeric band (31) and movable into a releasing position (55) of the drive-in ram (13) by a trigger switch (19).

5. A drive-in tool according to claim 1, comprising additional guide means for guiding the drive-in ram (13).

6. A drive-in tool according to claim 5, wherein the guide means comprises a guide channel (37) in the drive-in ram (13) in which a guide rod (38) is guided.

* * * * *